US011293221B2

(12) United States Patent
Tan et al.

(10) Patent No.: US 11,293,221 B2
(45) Date of Patent: Apr. 5, 2022

(54) STROKE HEAD OF A DRIVE APPARATUS FOR DRIVING CURTAIN LIFTING

(71) Applicant: NINGBO LIYANG NEW MATERIAL COMPANY LIMITED, Ningbo (CN)

(72) Inventors: Baoguo Tan, Ningbo (CN); Baowen Tan, Ningbo (CN)

(73) Assignee: NINGBO LIYANG NEW MATERIAL COMPANY LIMITED, Ningbo (CN)

( * ) Notice: Subject to any disclaimer, the term of this patent is extended or adjusted under 35 U.S.C. 154(b) by 120 days.

(21) Appl. No.: 16/821,129

(22) Filed: Mar. 17, 2020

(65) Prior Publication Data

US 2020/0300032 A1 Sep. 24, 2020

(30) Foreign Application Priority Data

Mar. 18, 2019 (CN) ..... 201920343856.7

(51) Int. Cl.
*E06B 9/42* (2006.01)
*E06B 9/72* (2006.01)

(52) U.S. Cl.
CPC . *E06B 9/42* (2013.01); *E06B 9/72* (2013.01)

(58) Field of Classification Search
CPC ..... E06B 9/42; E06B 9/72; E06B 9/50; E06B 9/82; A47H 5/02; A47H 5/14
See application file for complete search history.

(56) References Cited

U.S. PATENT DOCUMENTS 6,060,852 A * 5/2000 Domel ..... E06B 9/364 318/480
2015/0034259 A1* 2/2015 Bohlen ..... E06B 9/62 160/310

FOREIGN PATENT DOCUMENTS

CN 205558755 U * 9/2016 ..... E06B 9/08
EP 1013872 A1 * 6/2000 ..... E06B 9/72
FR 3069570 A1 * 2/2019 ..... E06B 9/72
JP 3223336 U * 10/2019 ..... E06B 9/50

* cited by examiner

*Primary Examiner* — Beth A Stephan
(74) *Attorney, Agent, or Firm* — W&KIP

(57) ABSTRACT

The present disclosure discloses a stroke head of a drive apparatus for driving curtain lifting, comprising a body, and the body is internally provided with a circuit board where a power switch is disposed, and the power switch is exposed outside the body. The power switch disposed on the stroke head brings the effects of facilitating switching on/off a power supply for people and saving electricity. When the stroke head after manufactured is assembled with a tubular drive unit and then warehoused, the power switch can be switched off to prevent power depletion, thereby ensuring sufficient electricity quantity left in the power supply after the power supply is assembled and switched on to debug the drive apparatus, and maintaining normal operation of the drive apparatus. In addition, a closed power supply is beneficial to lowering its explosion risk in transportation and improving safety.

3 Claims, 3 Drawing Sheets

STROKE HEAD OF A DRIVE APPARATUS FOR DRIVING CURTAIN LIFTING

CROSS-REFERENCE TO RELATED APPLICATIONS

This application claims priority to Chinese Patent Application No. 201920343856.7 with a filing date of Mar. 18, 2019. The content of the aforementioned applications, including any intervening amendments thereto, are incorporated herein by reference.

TECHNICAL FIELD

The present disclosure relates to the technical field of curtain accessories, in particular to a stroke head of a drive apparatus for driving curtain lifting.

BACKGROUND

Normally, a traditional curtain is dependent on manual pulling for opening and closing, which is relatively tiresome, and more and more curtains presently prefer dynamic drive, which are opened or closed under the control of signals transmitted by a remote control, thereby being convenient and labor-saving. It is conventional to dispose a drive apparatus in a roller blind tube of a roller blind to drive the roller blind tube to rotate so as to open or close the curtain. The drive apparatus is inserted into the roller blind tube in the form of a tube, and comprises a tubular drive unit and a stroke head connected with the tubular drive unit. The stroke head exposed at the end of the roller blind tube is used for connection with a curtain mounting element, thus facilitating the suspension of the curtain. The tubular drive unit comprises a motor, a retarding mechanism, a power pack and a control unit. The stroke head is internally provided with a circuit board that the circuit board and the control unit are in FPC connection. Both the power pack and the motor are electrically connected with the control unit. A deceleration mechanism is connected with the motor. The drive apparatus after production is generally stored in a warehouse, but its power pack and control unit are under an active state, and the electricity is consumed in the storage process, therefore the drive apparatus may fail to work after sale and installment due to exhausted electricity quantity. Meanwhile, there may also be potential safety issues in the transportation. It's a problem to be urgently resolved currently that maintaining the electricity quantity of the drive apparatus while avoiding the above safety hazards.

SUMMARY

One objective of the present disclosure is to overcome the shortcomings of the prior arts by providing a stroke head of a drive apparatus for driving curtain lifting, with the advantages of saving electricity quantity and improving safety.

The technical solution adopted to resolve the above technical problem in the present disclosure discloses a stroke head of a drive apparatus for driving curtain lifting, comprising a body, and the body is internally provided with a circuit board where a power switch is disposed, and the power switch is exposed outside the body.

In one embodiment, the body is centrally inserted with a connecting part for connection with a curtain mounting element and a through hole for the connecting part to pass through is formed in the circuit board.

In a preferred embodiment, a connecting groove is provided on the connecting part.

In a preferred embodiment, the body is also provided with a seal cap locking the connecting part, and the seal cap is provided with a central hole communicated with the connecting groove.

In a preferred embodiment, an antenna is arranged on the circuit board and built in the body.

In a preferred embodiment, the circuit board is also provided with an indicator light, a SETUP key, a charging interface and an FPC interface.

Compared with the prior art, the stroke head of a drive apparatus for driving curtain lifting disclosed in the present disclosure has the advantages that the power switch disposed on the stroke head brings the effects of facilitating switching on/off a power supply for people and saving electricity. When the stroke head is manufactured assembled with a tubular drive unit and then warehoused, the power switch can be switched off to prevent power depletion, thereby ensuring sufficient electricity quantity left in the power supply after the power supply is assembled and switched on to debug the drive apparatus, and maintaining normal operation of the drive apparatus. In addition, a closed power supply is beneficial to lowering its explosion risk in transportation and improving safety.

As shown in the FIGs: 1. body; 2 circuit board; 3 power switch; 4 connecting part; 5 through hole; 6 connecting groove; 7 seal cap; 8 central hole; 9 antenna; 10 indicator light; 11 SETUP key; 12 charging interface; 13 FPC interface; 14 light transmission hole; 15 button; 16 light-guiding column.

EMBODIMENTS

The illustrative embodiments herein will be described below using terms commonly employed by those skilled in the art to convey the substance of their work to others skilled in the art. However, it will be apparent to those skilled in the art that alternate embodiments may be practiced with only some of the described aspects. For purposes of explanation, specific numbers, material and configuration are set forth in order to provide a thorough understanding of the illustrative embodiments. However, it will be apparent to one skilled in the art that alternate embodiments may be practiced without the specific details. In other instances, well-known features are omitted or simplified in order not to obscure the illustrative embodiments.

Further, various operations will be described as multiple discrete operations, in turn, in a manner that is most helpful in understanding the illustrative embodiments; however, the order of description should not be construed as to imply that these operations are necessarily order dependent. In particular, these operations need not be performed in the order of presentation.

The phrase "in some embodiments" is used repeatedly. The phrase generally does not refer to the same embodiments; however, it may. The terms "comprising," "having" and "including" are synonymous, unless the context dictates otherwise.

Figure 1:
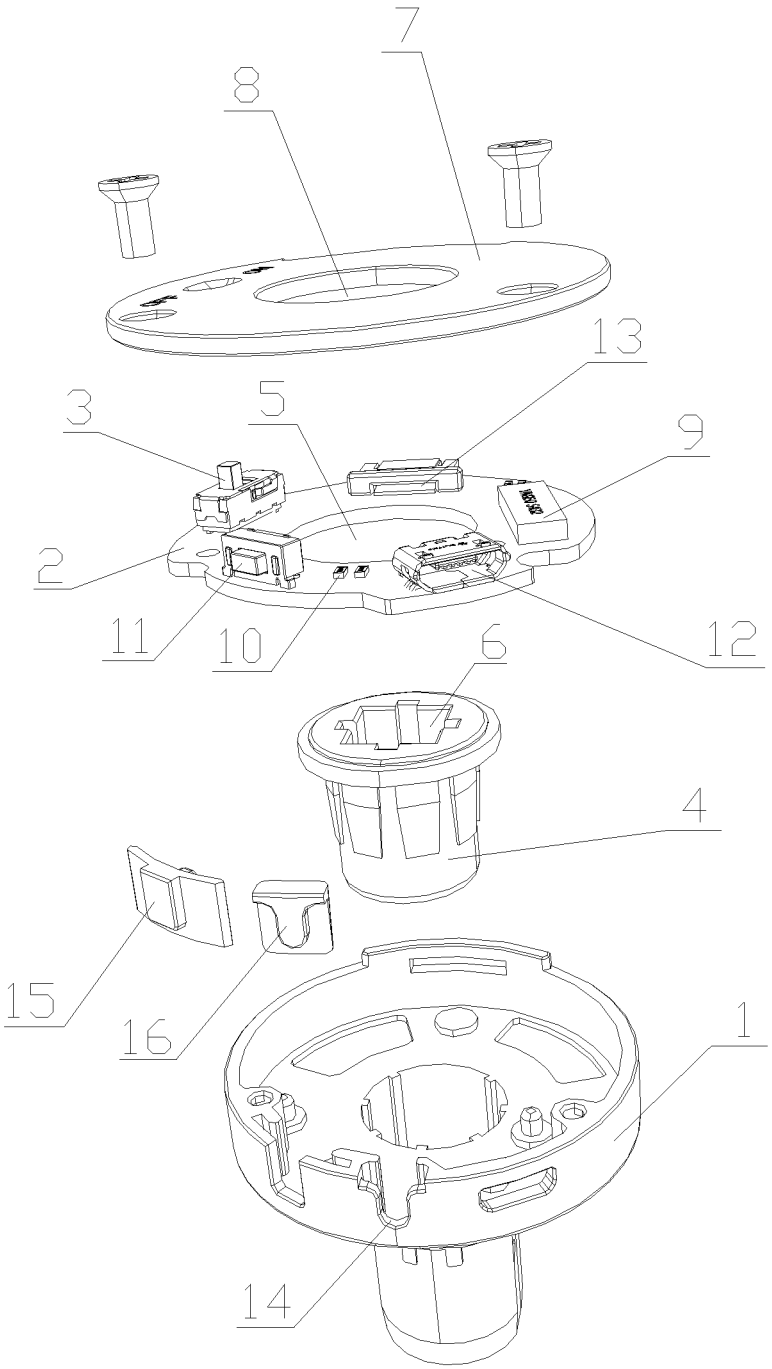
FIG. 1 is an exploded view of the present disclosure.
Figure 2:
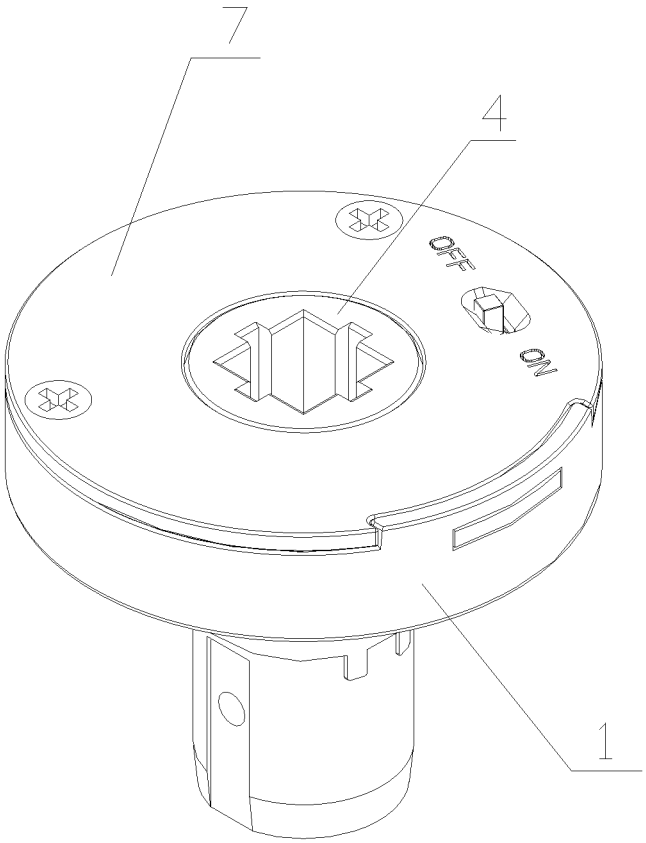
FIG. 2 is a schematically structural diagram of the present disclosure.
Figure 3:
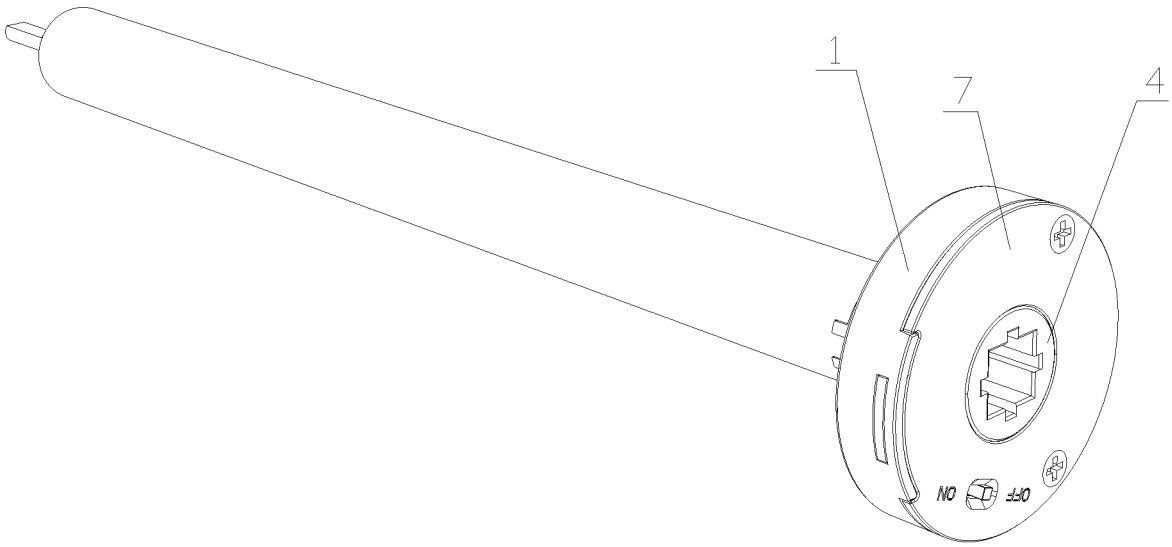
FIG. 3 is a schematically mounting diagram of the present disclosure.

As shown in FIGS. 1-3, there provides a stroke head of a drive apparatus for driving curtain lifting, comprising a body 1, and the body 1 is internally provided with a circuit board 2 where a power switch 3 is disposed. The power switch 3 is exposed outside the body 1 and used for controlling on/off of a power pack in the drive apparatus.

The power switch disposed on the stroke head in the present disclosure brings the effects of facilitating switching on/off a power supply for people and saving electricity. When the stroke head is manufactured assembled with a tubular drive unit and then warehoused, the power switch can be switched off to prevent power depletion, thereby ensuring sufficient electricity quantity left in the power supply after the power supply is assembled and switched on to debug the drive apparatus, and maintaining normal operation of the drive apparatus. In addition, a closed power supply is beneficial to lowering its explosion risk in transportation and improving safety.

The body 1 is centrally inserted with a connecting part 4 for connection with a curtain mounting element. The connecting part 4 is detachable, and during mounting, it can fit mounting elements of curtains of different types, thus having good popularity. A through hole 5 for the connecting part 4 to pass through is formed on the circuit board 2. The connecting part 4 is provided with a connecting groove 6 thereon for insertion with a mounting element. The body 1 is also provided with a seal cap 7 locking the connecting part 4 and fastened on the body 1 via screws. A central hole 8 communicated with the connecting groove 6 is formed on the seal cap 7. The connecting groove 6 on the connecting part 4 is peripherally provided with a stepped face for nesting of the seal cap 7 such that the connecting part 4 is locked on the body 1.

An antenna 9 is arranged on the circuit board 2 for receiving a remote-control signal and built in the body 1. The existing antenna of an extra-positioned structure hinders opening or closing of a curtain. In contrast, a built-in structure makes it possible that the antenna is hidden in the body, so the whole structure is concise and tidy.

The circuit board 2 is also provided with an indicator light 10, a SETUP key 11, a charging interface 12 and an FPC interface 13. Lamplight from the indicator light 10 is guided out of the body 1 via the light-guiding column 16 so that people can discern that the control device is under the working state. A light transmission hole 14 is formed on the position corresponding to the indicator light 10, on the body 1. Arrangement of the SETUP key 11 brings convenience for people to manually debug the drive apparatus. A button 15 is placed at the position corresponding to the SETUP key 11 on the body 1. The charging interface 12 can be connected with a charging wire to charge a power pack. The FPC interface 13 is used for FPC insertion.

When in use, the circuit board 2 provided with the power switch 3, the antenna 9, the indicator light 10, the SETUP key 11, the charging interface 12 and the FPC interface 13 is placed into the body 1, then the connecting part 4 is inserted into the body 1, the seal cap 7 is nested on the connecting part 4 and fastened on the body 1 through screws, finally the assembled stroke head is inserted with a tubular drive unit to form the drive apparatus. As shown in FIG. 3, a control unit in the tubular drive unit is connected with the circuit board 2 via an FPC, and a power pack in the tubular drive unit is electrically connected with the control unit. The power switch 3 is able to switch on/off the power supply. When the drive apparatus is stored, the power switch 3 is switched off so as to save electricity quantity in the power pack. After the drive apparatus and the curtain are assembled, the power switch 3 is switched on, the antenna 9 receives a remote-control signal and feeds back the received signal to the control unit, and the control unit instructs the motor to act so as to achieve opening or closing of the curtain.

It should be noted that, the above embodiments are merely illustrative, rather than restrictive, to the technical solutions of the present disclosure. Although the present disclosure has been explained in detail by referring to the abovementioned embodiments, it should be understood by those skilled in the art that, modifications to the technical solutions in the embodiments or equivalent substitutions of portion of technical features are allowed. These modifications or substitutions shall not cause the corresponding technical solutions to depart from the spirit and scope of the technical solutions of the embodiments of the present disclosure.

We claim:

1. A stroke head of a drive apparatus for driving curtain lifting, comprising a body, wherein the body is internally provided with a circuit board; the circuit board is installed with a power switch, and the power switch is exposed outside the body;

wherein the body is centrally inserted with a connecting part for connection with a curtain mounting element and a through hole for the connecting part to pass through is formed in the circuit board;

wherein a connecting groove is provided on the connecting part;

wherein the body is also provided with a seal cap locking the connecting part, and the seal cap is provided with a central hole connected to the connecting groove.

2. The stroke head of a drive apparatus for driving curtain lifting of claim 1, wherein an antenna is arranged on the circuit board and built in the body.

3. The stroke head of a drive apparatus for driving curtain lifting of claim 2, wherein the circuit board is also provided with an indicator light, a SETUP key, a charging interface and an FPC interface.

* * * * *